US007500823B2

(12) United States Patent
Bolms et al.

(10) Patent No.: US 7,500,823 B2
(45) Date of Patent: Mar. 10, 2009

(54) TURBINE BLADE

(75) Inventors: Hans-Thomas Bolms, Mülheim an der Ruhr (DE); Ralf Müsgen, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 692 days.

(21) Appl. No.: 11/174,275

(22) Filed: Jul. 1, 2005

(65) Prior Publication Data

US 2006/0002796 A1 Jan. 5, 2006

(30) Foreign Application Priority Data

Jul. 5, 2004 (EP) ..... 04015805

(51) Int. Cl.
*F01D 25/12* (2006.01)

(52) U.S. Cl. ..... 415/115; 416/97 R

(58) Field of Classification Search ..... 415/115; 416/97 R, 96 R, 96 A
See application file for complete search history.

(56) References Cited

U.S. PATENT DOCUMENTS

| | | | | |
|---|---|---|---|---|
| 3,527,543 | A * | 9/1970 | Howald | 416/90 R |
| 5,486,093 | A * | 1/1996 | Auxier et al. | 416/97 R |
| 5,496,151 | A | 3/1996 | Coudray et al. | |
| 5,779,437 | A | 7/1998 | Abdel-Messeh et al. | |
| 6,176,676 | B1 | 1/2001 | Ikeda et al. | |

FOREIGN PATENT DOCUMENTS

| | | |
|---|---|---|
| EP | 0 894 946 A1 | 2/1999 |
| GB | 2 310 896 A | 9/1997 |
| JP | 58 05 1202 | 3/1983 |

* cited by examiner

*Primary Examiner*—Ninh H Nguyen

(57) ABSTRACT

A turbine blade (2), with a root section (4), with a tip section (6) and with a blade leaf (12) which is provided with a number of coolant ducts (22) through which a coolant (K) is capable of flowing, outlet ducts (34) which issue in outlet ports (24) branching off, in the leading edge region (28) of the blade leaf (12), from a coolant duct (22) running essentially in the longitudinal direction (L) of the turbine blade (2) and spaced apart from the leading edge (14), the outlet ports (24) being arranged along at least two rows oriented essentially parallel to the leading edge (14), and the outlet ducts (34) being oriented, in the region of their respective outlet port (24), obliquely with respect to the longitudinal direction (L) of the turbine blade (2), in such a way that the coolant (K) flowing out in a root-side subsection (38) of each row possesses, in the region of the outlet ports (24), a velocity component pointing toward the tip section (6) of the turbine blade (2), and the coolant (K) flowing out in a tip-side subsection (42), continguous thereto, of each row has a velocity component pointing toward the root section (4), is designed for a particularly reliable and uniform cooling of the leading edge region (28), at the same time with the requirement for coolant (K) being kept particularly low. For this purpose, according to the invention, the transitional points (40) at which the orientation of the outlet ducts (34) changes are arranged so as to be offset relative to one another in the longitudinal direction (L) in each case for two adjacent rows.

15 Claims, 3 Drawing Sheets

TURBINE BLADE

CROSS REFERENCE TO RELATED APPLICATIONS

This application claims priority of European application No. 04015805.7 EP filed Jul. 5, 2004, which is incorporated by reference herein in their entirety.

FIELD OF INVENTION

The invention relates to a turbine blade for use in a gas turbine, with a blade leaf which is provided with a number of coolant ducts through which a coolant is capable of flowing, outlet ducts, which issue in outlet ports, branching off, in the leading edge region of the blade leaf, from a coolant duct running essentially in the longitudinal direction of the turbine blade and spaced apart from the leading edge.

BACKGROUND OF INVENTION

Gas turbines are employed in many sectors for the drive of generators or of working machines. In this context, the energy content of a fuel is utilized in order to generate a rotational movement of the turbine shaft. For this purpose, the fuel is burnt in a combustion chamber, compressed air being supplied by an air compressor. The working medium, which is generated in the combustion chamber as a result of the combustion of the fuel and which is under high pressure and under a high temperature, is in this case routed via the turbine unit which follows the combustion chamber and where the working medium expands so as to perform work.

In this case, in order to generate the rotational movement of the turbine shaft, the latter has arranged on it a number of moving blades which are conventionally combined in blade groups or blade rows and which drive the turbine shaft via pulse transmission from the flow medium. Moreover, in order to route the flow medium in the turbine unit, guide vane rows connected to the turbine casing are usually arranged between adjacent moving blade rows. The turbine blades, in particular the guide vanes, in this case usually have, for the suitable routing of the working medium, a blade leaf which is extended along a blade axis and onto which a platform extending transversally with respect to the blade axis can be integrally formed on the end face for fastening the turbine blade to the respective carrier body. However, a platform or a platform-like configuration may also be attached to the other free end.

The design of gas turbines of this type is usually aimed at particularly high efficiency in addition to achievable power. In this case, for thermodynamic reasons, an increase in efficiency can be achieved, in principle, by an increase in the outlet temperature at which the working medium flows out of the combustion chamber and into the turbine unit. Temperatures of about 1200° C. to 1300° C. for turbines of this type are therefore sought after and even achieved.

At such high temperatures of the working medium, however, the components and structural parts exposed to this are exposed to high thermal loads. In order, nevertheless, to ensure a comparatively long useful life of the relevant components, along with high reliability, a cooling of the relevant components, in particular of moving blades and/or guide vanes of the turbine unit, is conventionally provided. The turbine blades are in this case conventionally designed to be coolable, in which case, in particular, an effective and reliable cooling of the leading edge of the respective turbine blade, said leading edge being subjected to particularly high thermal load, is to be ensured.

The coolant used is in this case usually cooling air. This is normally supplied to the respective turbine blade in the manner of open cooling via a number of coolant ducts integrated into the blade leaf or the blade profile. The cooling air, emanating from these coolant ducts, flows, in outlet ducts branching off from the latter, to the regions of the turbine blade which are in each case provided, with the result that a convective cooling of the blade interior and of the blade wall is achieved. These ducts are left open on the outlet side, so that the cooling air, after flowing through the turbine blade, emerges from the outlet ports, also designated as film cooling holes, and forms a cooling air film on the surface of the blade leaf. This cooling air film largely protects the material on the surface against direct and over intensive contact with the hot working medium flowing past at high velocity.

In order to make it possible to have particularly uniform and effective film cooling in the leading edge region of the blade leaf, the outlet ports are conventionally arranged there uniformly along at least two rows oriented parallel to the leading edge. Moreover, as a rule, the outlet ducts are oriented obliquely with respect to the longitudinal direction of the turbine blade, thus assisting the formation of the protective cooling air film flowing along the surface. Since, in the production of the turbine blade, the outlet ducts are normally introduced from outside at the conclusion for cost reasons, for example by laser drilling or other drilling methods, and particularly in the leading edge region of the blade leaf, access for the drilling instrument through the platform or platform-like configurations integrally formed on the end face is possibly obstructed, there is often, with regard to the oblique setting of the outlet ducts, a change in orientation at a transitional point lying approximately centrally between the root section and tip section of the respective blade leaf This takes place in that the coolant flowing out in a root-side subsection of each row possesses, in the region of the outlet ports, a velocity component which points toward the tip section, whereas cooling medium flowing out in a tip-side subsection, contiguous thereto, of each row has a velocity component pointing toward a root section. In other words: in the root-side subsection, the outlet ducts are inclined in the direction of extent to the turbine blade, whereas, in the tip-side subsection, they are inclined opposite to the direction of extent.

Such an arrangement of the outlet ducts may, however, also entail disadvantages. If the change in their orientation and the associated change in the branch-off angle with respect to the coolant duct running in the longitudinal direction and corresponding to the leading edge takes place in a locally abrupt way, then, at the transitional point, possibly relatively large regions between the leading edge and the coolant duct are not penetrated by outlet ducts and therefore also not cooled convectively. This shortcoming then has to be compensated, where appropriate, by cooling air being used to an increased extent in a controlled way. If, instead, the change in orientation of the outlet ducts occurs comparatively continuously, the formation of a film of cooling air flowing along the surface of the blade leaf is impeded in the transitional region, since, there, the cooling air emerges from the film cooling holes almost perpendicularly to the surface and therefore tends to break away from the latter. In this case, too, cooling air has to be supplied to an increased extent, which, in turn, means losses in the available compressor mass flow and diminishes the efficiency of the gas turbine.

SUMMARY OF INVENTION

An object on which the invention is based is, therefore, to specify a turbine blade of the abovementioned type, for which a particularly reliable and uniform cooling of the leading edge region, at the same time with a cooling air requirement kept particularly low, can be achieved by simple means.

This object is achieved, according to the invention in that the transitional points at which the orientation of the outlet ducts changes, are arranged, in each case for two adjacent rows, to be offset relative to one another in the longitudinal direction.

The invention in this case proceeds from the consideration that, to form an effective cooling film, the cooling medium emerging from the outlet ports in the leading edge region of the blade leaf should have as high a velocity component as possible parallel to the surface. For this reason, the proven orientation of the outlet ducts which runs obliquely with respect to the longitudinal direction should be maintained. In light of the restrictions given in the production of the blade leaf and relating to the access and orientation of the production tools, a change in orientation of the type described is also still desirable for the outlet ducts issuing in the outlet ports along each of the rows in which the outlet ports are arranged. On the other hand, regions with a comparatively highly reduced frequency density of the outlet ducts in the blade wall should be avoided. For this purpose, the situation must be ruled out where the gaps or interspaces belonging to adjacent rows come to lie directly next to one another in the otherwise comparatively regular distribution pattern of the outlet ducts.

This is achieved in that, in each case for two adjacent rows, the associated transitional points are arranged so as to be offset relative to one another in the longitudinal direction. To be precise, the offset gives rise precisely to a local interlacing of the outlet ducts belonging in each case to two adjacent rows and therefore, in terms of all the rows as a whole, to a comparatively homogeneous distribution of the outlet ducts over the entire leading edge region of the blade leaf. In this region, too, therefore, a comparatively good and effective convective cooling of the blade interior is ensured, so that a local overstressing of the material due to overheating is avoided. As compared with known versions, the cooling medium requirement can be kept comparatively low, which has a power-promoting effect for a gas turbine equipped with turbine blades of this type.

A flow behavior, particularly beneficial for effective film cooling, of the emerging cooling medium in the vicinity of the leading edge, in combination with a good convective cooling of the contiguous blade wall, can be achieved in that, in an advantageous development of the invention, the outlet ports in the entire leading edge region are distributed approximately uniformly, in such a way that they lie at the corner points of an imaginary regular grid bent around the leading edge of the blade leaf. This gives rise to a particularly homogeneous wetting of the blade surface with coolant.

The angles of incidence of the outlet ducts with respect to the longitudinal direction are preferably in each case approximately identical for the root-side and tip-side subsections of all the rows of outlet ports. In this case, a value optimized for the film cooling effect and known from tests or calculations can be set.

The concept of the partial interlacing of adjacent film cooling rows can be applied to any number of rows lying next to one another. However, since the radius of curvature of a blade leaf is often relatively small in the vicinity of the leading edge, only a few rows of outlet ports can then be accommodated in the leading edge region. However, even in a preferred embodiment with three rows, a uniform cooling of the leading edge which is particularly economical in terms of the coolant consumption can be achieved. In this variant, the transitional points belonging to the two outer rows are expediently arranged identically and therefore symmetrically to the middle row with respect to the longitudinal direction.

Advantageously, in this case, the transitional point belonging to the middle row is displaced with respect to the two outer rows by the amount of three outlet ports. With this selection, on the one hand, there is a relatively good penetration of the blade wall with outlet ducts in the leading edge region and, on the other hand, the mutual offset is still sufficiently small to ensure that the airstreams emerging in opposite directions in the interlacing region clash with one another only insignificantly.

This optimized arrangement of film cooling bores is particularly advantageous in the case of a guide vane which is provided for use in a gas turbine and which is closed off both at the root-side end and at the tip-side end by possibly bulky and massive platforms which particularly obstruct the access of drilling tools for producing the outlet ducts.

The advantages achieved by means of the invention are, in particular, that the offset to the transitional points in which the orientation of the outlet ducts changes with respect to the longitudinal direction affords a turbine blade which can be produced at lower outlay and which, in the region of the leading edge subjected to particularly high stress, is protected, both on the surface by a uniform cooling air film and in the inner region owing to the convection of cooling air in the outlet ducts distributed approximately homogenously and without any gaps of relatively great extent, against excessive stress caused by heating during operation in a gas turbine. Cooling air can thereby be saved, thus increasing the efficiency of the gas turbine.

BRIEF DESCRIPTION OF THE DRAWINGS

An exemplary embodiment of the invention is explained in more detail by means of a drawing in which.

Identical parts are given the same reference symbols in all the figures.

DETAILED DESCRIPTION OF INVENTION

Figure 1:
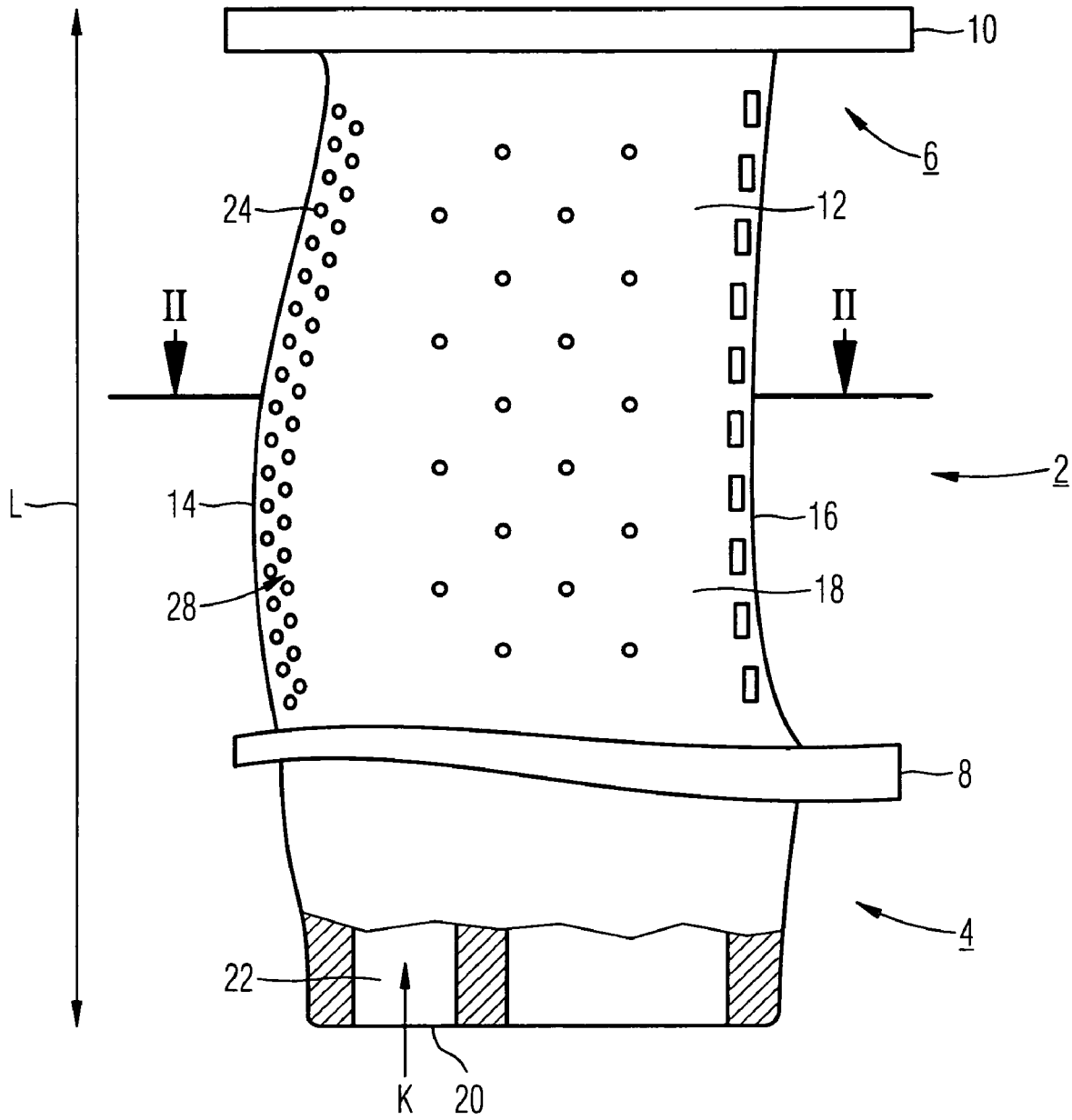
FIG. 1 shows a partly sectional side view of a turbine blade.

The turbine blade 2 according to FIG. 1 is designed as a guide vane for a gas turbine, not illustrated in any more detail here. It comprises a root section 4 and a tip section 6 with associated platforms 8, 10 and with a blade leaf 12 lying between them and extending in the longitudinal direction L. The profiled blade leaf 12 has a leading edge 14 extending likewise essentially in the longitudinal direction L and a trailing edge 16 with side walls 18 lying between them. The turbine blade 2 is fixed to the inner casing of the turbine via the root section 4, the associated platform 8 forming a wall element delimiting the flow path of the working medium in the gas turbine. The tip-side platform 10 located opposite the turbine shaft forms a further boundary for the flowing working medium. The turbine blade 2 could alternatively also be designed as a moving blade which is fastened in a similar way to the turbine shaft via a root-side platform 8 designed as a blade root.

A coolant K is introduced into the blade interior via a number of inlet ports 20 arranged at the lower end of the root section 4. Concepts are also known, however, in which the delivery of the coolant K takes place via the tip-side platform 10. The coolant K is normally cooling air. After the coolant K has flowed through one or more coolant ducts 22 adjoining the inlet ports 20 and located inside the turbine blade 2, it emerges from a number of outlet ports 24 in the region of the blade leaf 12 which are also designed as film cooling holes and correspond with the coolant ducts 22. Thus, in terms of the various kinds of thermal and mechanical load and of the respective space conditions of the blade interior, different regions of the blade leaf 12 present completely different requirements as to the arrangement and configuration of the film cooling holes. In particular, the comparatively highly curved leading edge region 28 directly adjoining the leading edge 14 of the blade leaf 12 requires effective cooling on account of a relatively high load.

Figure 2:
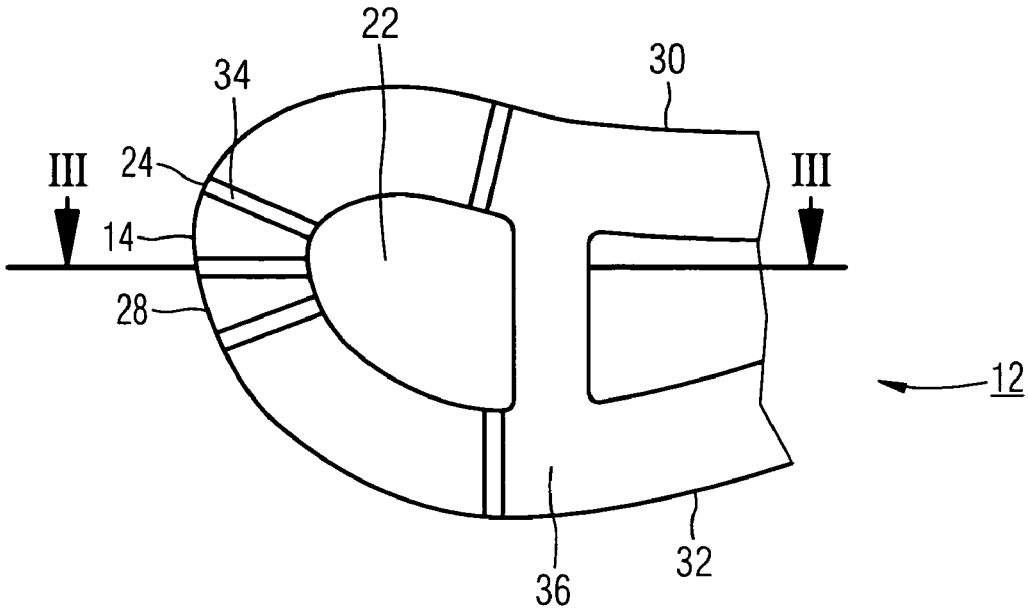
FIG. 2 shows a partial cross section through the turbine blade according to FIG. 1.

FIG. 2 shows the front region of the profiled blade leaf 12 with the relatively highly curved leading edge region 28 which comprises the leading edge 14 on which the delivery side 30 and suction side 32 adjoin. From a coolant duct 22 running essentially in the longitudinal direction L of the turbine blade 2 and spaced apart from the leading edge 14, outlet ducts 34 of smaller cross section branch off, which penetrate through the blade wall 36 and issue in the leading edge region 28 in outlet ports 24 or film cooling holes. A cooling of the contiguous zones of the blade wall 36 is achieved by coolant K flowing through the outlet ducts 34. In addition to this convective cooling of the blade interior, the effective film cooling on the surface of the blade leaf 12, caused by the cooling air flowing out of the outlet ports 24, arises. Thus, as it were, an air cushion or protective film is formed on the surface by the cooling air flowing along the latter at relatively low velocity and prevents direct contact of the blade surface with the working medium which has a high flow velocity.

Figure 3:
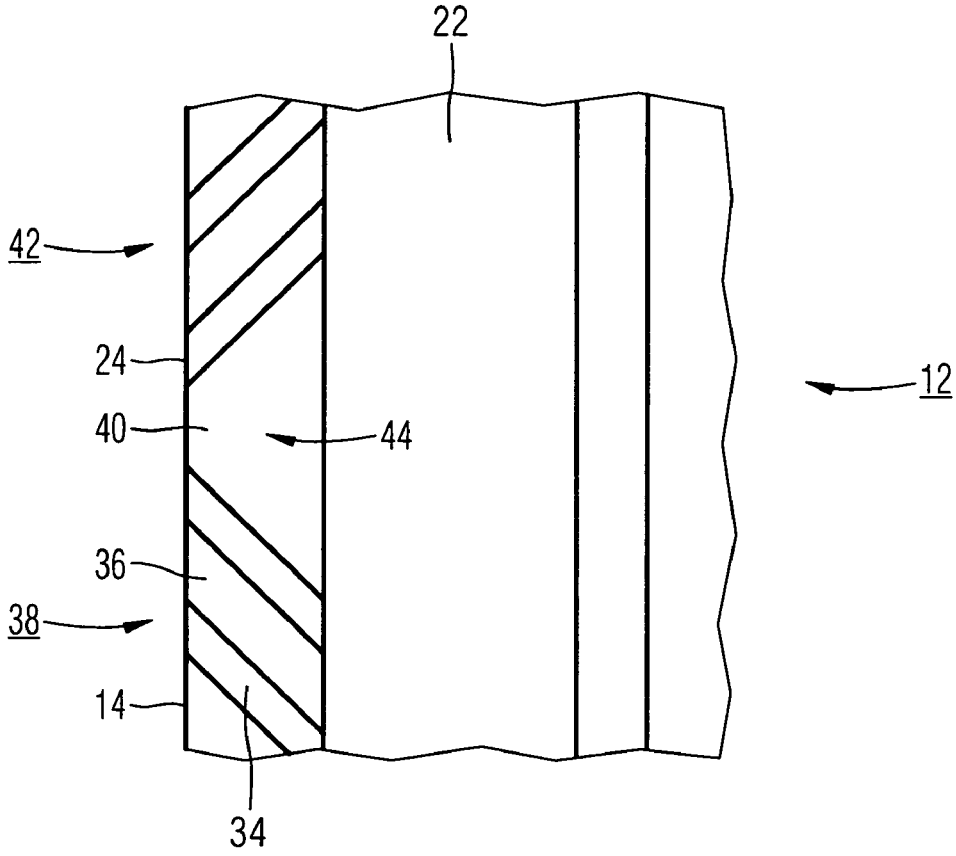
FIG. 3 shows a partial longitudinal section through the turbine blade according to FIG. 1.

In order, on the one hand, to allow a uniform convective cooling of the blade wall 36 and, on the other hand, to promote the formation of a continuous cooling air film, in the exemplary embodiment the outlet ports 24 are arranged along three rows oriented parallel to the leading edge 14, in such a way that they form a regular grid pattern. Moreover, the outlet ducts 34 are inclined with respect to the longitudinal direction L of the turbine blade 2, so that in the region of their outlet ports 24, a flat outlet angle with respect to the blade surface is obtained for the out flowing coolant K. This likewise has a beneficial effect on the generation of a protective cooling air film. As may be gathered from the longitudinal section along the middle row of outlet ports 24 according to FIG. 3, there are two different subsections with regard to the inclination of the outlet ducts 34. In a root-side subsection 38 of the row illustrated, they are inclined in such a way that the coolant K flowing out of the outlet ports 24 possesses a velocity component pointing toward the tip section 6 of the turbine blade 2. At a contiguous transitional point 40, the orientation of the outlet ducts 34 changes, so that the coolant K flowing out of the tip-side subsection 42 of the row has a velocity component directed toward the root section 4. This change in orientation is due to the access of the drilling tools in the production of the turbine blade 2, this access being restricted on account of the platforms 8, 10, and entails the presence of a comparatively large gap 44 in the blade wall 36 otherwise penetrated uniformly by outlet ducts 34. What has just been said applies accordingly to each of the three rows of outlet ports 24 arranged in the leading edge region 28 of the blade leaf 12.

Figure 4:
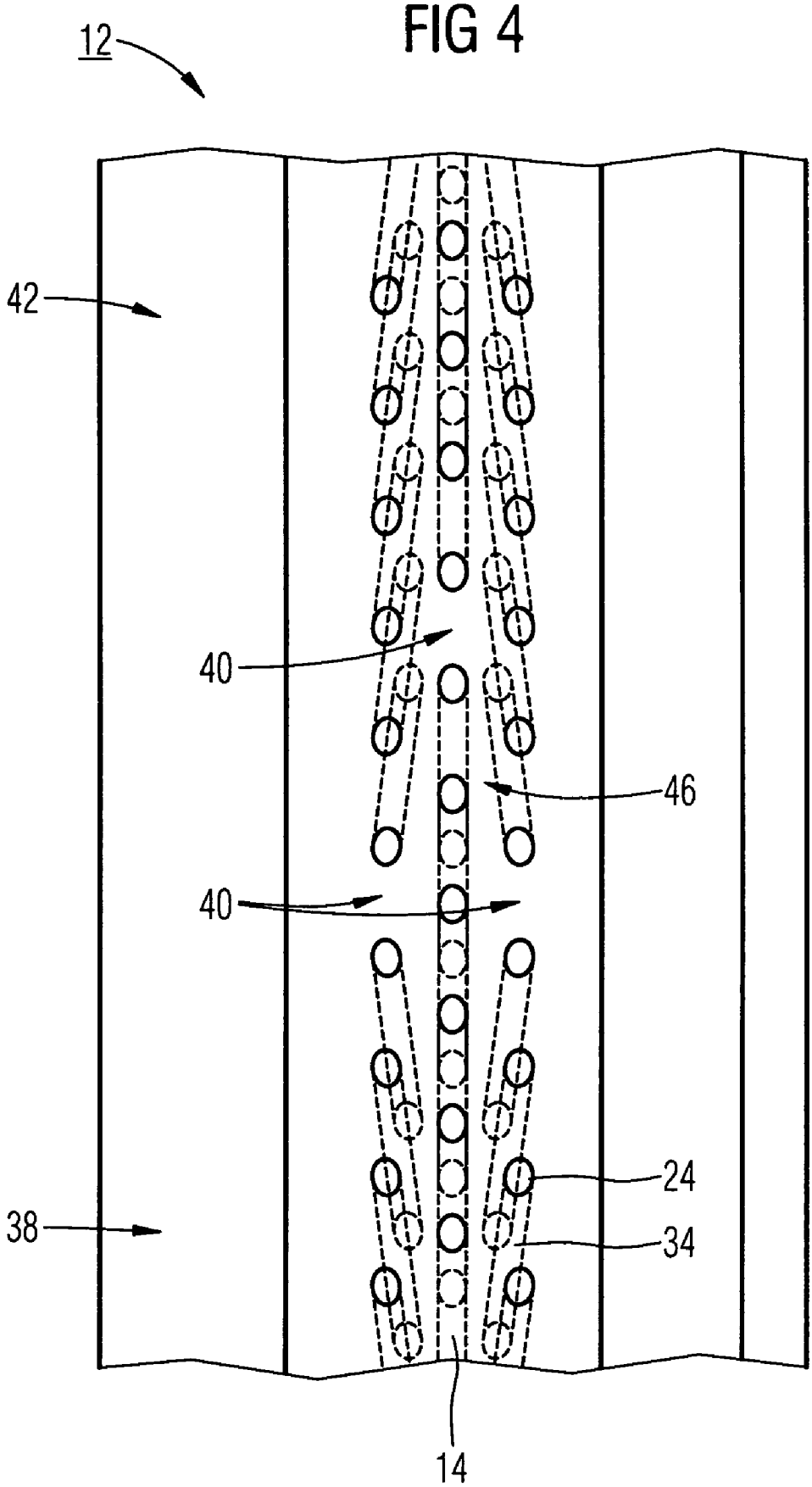
FIG. 4 shows a partly sectional view of the leading edge of the turbine blade according to FIG. 1

The turbine blade 2 is specifically designed for a particularly reliable cooling of the leading edge region 28, at the same time with the requirement for coolant K being kept particularly low. For this purpose, said transitional points 40 are positioned, offset with respect to one another, in the manner of a partially interlaced arrangement of adjacent film cooling rows. To be precise, the partly sectional perspective view of the leading edge 14 in FIG. 4 shows that the transitional point 40 which belongs to the middle row and at which the orientation of the outlet ducts 34 changes, is displaced with respect to the two outer rows in the longitudinal direction L. This displacement here amounts to three grid dots in the exemplary embodiment. As a result, the gaps 44 belonging in each case to two adjacent rows are also arranged so as to be offset relative to one another with respect to the outlet ducts 34 to an extent such that, overall, a comparatively good penetration of the blade wall 36 by outlet ducts 34 and therefore also comparatively good convective cooling are ensured in the entire interlacing zone 46. Since, on the other hand, the selected mutual displacement of the transitional points 40 is not appreciably greater than the minimum amount necessary for this purpose, the swirling of the cooling air film flowing on the surface on account of the air streams directed opposite one another in this section is also restricted to a necessary minimum.

An arrangement of outlet ducts 34 and of associated outlet ports 24 is consequently provided which is optimized both in terms of the convective cooling of the blade wall 36 and in terms of film cooling on the surface and which, as compared with the known solutions, is distinguished by a reduced consumption of coolant K and thus increases the efficiency of the gas turbine equipped with turbine blades 2 of this type.

The invention claimed is:

1. A turbine blade, comprising:

a root section;

a tip section;

a blade leaf having a plurality of coolant ducts through which a coolant flows and having a leading edge with a leading edge region, the coolant ducts extending essentially in a longitudinal direction of the turbine blade and spaced apart from the leading edge;

a plurality of outlet ports arranged along at least two rows oriented on the blade leaf essentially parallel to the leading edge; and a plurality of outlet ducts oriented obliquely with respect to the longitudinal direction of the turbine blade so that the coolant flowing out in a root-side subsection of each row possesses a velocity component oriented toward the tip section of the turbine blade and that the coolant flowing out in a tip-side subsection of each row has a velocity component oriented toward the root section, wherein:

the outlet ducts are configured with a plurality of transitional points, at which the orientation of the outlet ducts changes, arranged to be offset relative to one another in the longitudinal direction for two adjacent rows; and the transitional points of two outer rows are arranged identically with respect to the longitudinal direction.

2. The turbine blade as claimed in claim 1, wherein the coolant ducts extends substantially in a longitudinal direction of the turbine blade and the plurality of outlet ports are arranged along at least two rows oriented on the blade leaf substantially parallel to the leading edge.

3. The turbine blade as claimed in claim 1, wherein the outlet ports in the leading edge region lie approximately on a plurality of grid dots of a regular grid.

4. The turbine blade as claimed in claim 1, wherein angles of incidence of the outlet ducts with respect to the longitudinal direction are approximately identical for the root-side and the tip-side subsections of all the rows of outlet ports.

5. The turbine blade as claimed in claim 4, wherein the turbine blade has at least three rows of the outlet ports.

6. The turbine blade of claim 1, wherein the transitional point of a middle row is displaced with respect to two outer rows by the amount of three outlet ports.

7. The turbine blade as claimed in claim 1, wherein the turbine blade is a guide vane.

8. The turbine blade as claimed in claim 1, wherein the turbine blade is operatively connected to a gas turbine.

9. A gas turbine, comprising:

a compressor section that compresses air;

a combustion section that combusts a mixture of a fuel and the compressed air; and a turbine blade adapted to allow a coolant to flow within the turbine blade from an inlet port through a plurality of outlet ducts, and through a series of outlet ports, the turbine blade including a blade section having a plurality of the outlet ducts and having a leading edge with a leading edge region, the outlet ducts running essentially in the longitudinal direction of the turbine blade and spaced apart from the leading edge, configured with (i) a plurality of the outlet ports arranged along a plurality of rows that are essentially parallel to the leading edge;

(ii) a plurality of the outlet ducts each coupled to pass fluid through one of the outlet ports and oriented obliquely with respect to the longitudinal direction of the turbine blade so that the coolant flowing out in a root-side subsection of each row possesses a velocity component oriented toward the tip section of the turbine blade and so that the coolant flowing out in a tip-side subsection of each row has a velocity component oriented toward the root section;

(iii) the outlet ducts arranged according to a plurality of transitional points at which the orientation of the outlet ducts in each row changes, with the transition points arranged to be offset relative to one another in the longitudinal direction for two adjacent rows; and (iv) the transitional points of two outer rows arranged identically with respect to the longitudinal direction.

10. The gas turbine as claimed in claim 9, wherein the outlet ports in the leading edge region lie approximately on a plurality of grid dots of a regular grid.

11. The gas turbine as claimed in claim 9, wherein angles of incidence of the outlet ducts with respect to the longitudinal direction are approximately identical for a root-side and a tip-side subsections of all the rows of outlet ports.

12. The gas turbine as claimed in claim 11, wherein the turbine blade has at least three rows of the outlet ports.

13. The turbine blade as claimed in claim 12, wherein the transitional point of a middle row is displaced with respect to two outer rows by the amount of three outlet ports.

14. The gas turbine as claimed in claim 9, wherein the turbine blade is a guide vane.

15. The gas turbine as claimed in claim 9, wherein the gas turbine includes a plurality of the turbine blades.

* * * * *